United States Patent [19]

Takagi et al.

[11] Patent Number: 4,481,285

[45] Date of Patent: Nov. 6, 1984

[54] METHOD OF TREATING DIRECT POSITIVE SILVER HALIDE SENSITIVE MATERIAL

[75] Inventors: Yoshihiro Takagi; Shigeo Hirano; Tadao Sugimoto, all of Kanagawa, Japan

[73] Assignee: Fuji Photo Film Co., Ltd., Kanagawa, Japan

[21] Appl. No.: 484,811

[22] Filed: Apr. 14, 1983

[30] Foreign Application Priority Data

Apr. 14, 1982 [JP] Japan ..... 57-61935

[51] Int. Cl.[3] ..... G03C 5/24

[52] U.S. Cl. ..... 430/410; 430/598; 430/940; 430/564

[58] Field of Search ..... 430/410, 598, 940, 564

[56] References Cited

U.S. PATENT DOCUMENTS 4,110,338 8/1978 Kamiya et al. ..... 260/308 D 4,374,923 2/1983 Hirano et al. ..... 430/598

*Primary Examiner*—Won H. Louie

*Attorney, Agent, or Firm*—Sughrue, Mion, Zinn, Macpeak & Seas

[57] ABSTRACT

A method of treating a direct positive silver halide sensitive material is disclosed. The material is comprised of a base having thereon a compound represented by the general formula (I), a sensitive silver halide photographic emulsion layer and a hydrophilic colloid layer. The exposed material is developed in the presence of the compound represented by the general formula (II)

(I)

wherein $R^1$ and $R^2$ independently represent a hydrogen atom, an aliphatic residue, an aromatic residue or a heterocyclic residue, $R^3$ represents a hydrogen atom or an aliphatic residue, $R^4$ represents a hydrogen atom, an aliphatic residue or an aromatic residue, and X represents a divalent aromatic residue;

(II)

wherein $R^1$ and $R^2$ represent each a hydrogen atom or an aliphatic residue, and $R^1$ and $R^2$ may form a ring by linking together, $R^3$ represents a divalent aliphatic residue, X represents a single bond or a divalent heterocyclic ring containing nitrogen, oxygen or sulfur atoms, and M represents a hydrogen atom, an alkali metal, an alkaline earth metal, a quaternary ammonium salt, a quaternary phosphonium salt or an amidino group.

The invention provides a process wherein the sharpness and edge effects of direct positive images are greatly improved. The results obtained with the process do not vary due to changes in the bromine ion concentration in the developing solution or the pH thereof.

17 Claims, 1 Drawing Figure

METHOD OF TREATING DIRECT POSITIVE SILVER HALIDE SENSITIVE MATERIAL

FIELD OF THE INVENTION

The present invention relates to silver halide photographic sensitive materials which form direct positive photographic images and, particularly, to a method of improving the quality of direct positive images.

BACKGROUND OF THE INVENTION

In a field of silver halide photographic process, a photographic process capable of obtaining positive images without forming negative images or carrying out intermediate treatment for negative images is called a direct positive photographic process. A photographic sensitive material and a photographic emulsion used for such a photographic process are called direct positive sensitive material and direct positive photographic emulsion, respectively.

Although there are many kinds of direct positive photographic process, a process which comprises exposing previously fogged silver halide particles to light in a presence of a desensitizer and thereafter developing and a process which comprises exposing a silver halide emulsion having sensitive nuclei in principally the inner part of silver halide particles to light and thereafter developing in a presence of a fogging agent are most useful. The present invention relates to the latter. The silver halide emulsion having sensitive nuclei in principally the inner part of silver halide particles, which forms latent images in principally the inner part of particles is called an inner latent image type silver halide emulsion which is distinguished from a silver halide emulsion forming latent images on the surface of particles.

A process for obtaining direct positive images which comprises carrying out surface development of the inner latent image type silver halide photographic emulsion in the presence of a fogging agent and photographic emulsions and photographic sensitive materials used for such a process are known and described in U.S. Pat. Nos. 2,456,953, 2,497,875, 2,497,876, 2,588,982, 2,592,250, 2,675,318, 3,227,552 and 3,761,276, British Pat. Nos. 1,011,062 and 1,151,363, and Japanese Patent Publication 29405/68, etc.

In the above-described process for obtaining direct positive images, the fogging agent may be added to a developing solution. However, if the fogging agent is added to a photographic emulsion layer or another layer in the sensitive material so as to be adsorbed on the surface of silver halide particles, better reversal property can be obtained.

Fogging agents used in the above-described process for obtaining direct positive images are known and include hydrazine and derivatives thereof described in U.S. Pat. Nos. 2,563,785, 2,588,982 and 3,227,552. Particularly, U.S. Pat. No. 3,227,552 describes that hydrazides which are hydrazine derivatives and hydrazine compounds can be used by adding not only to a developing solution but also to a sensitive layer.

Other known fogging agents include heterocyclic quaternary salt compounds described in U.S. Pat. Nos. 3,615,615, 3,719,494, 3,734,738 and 3,759,901 and Japanese Patent Application (OPI) Nos. 3426/77 and 69613/77 (the term "OPI" as used herein refers to a "published unexamined Japanese patent application").

Moreover, it has been proposed to use acylhydrazinophenylthiourea compounds in U.S. Pat. No. 4,030,925 (corresponding to German Patent Application (OLS) No. 2,635,316) and 4,031,127 (corresponding to German Patent Application (OLS) No. 2,635,317).

However, these known fogging agents are not desirable because of their bad influence upon preservability of the direct positive sensitive materials, they have an insufficient ability to fog an inner latent image typ silver halide having a small particle size, their reversal property varies greatly due to variation of bromine ion concentration in the developing solution, and the reversal property varies greatly due to variations in the amount to be added, etc.

On the other hand, direct positive images obtained by using a core/shell type emulsion together with a fogging agent represented by the general formula (I) as described later are not desirable because the images are inferior in sharpness and edge effect forming so-called loose images, the reason of which is not clear. Further, the process is not desirable because its application is restricted, though it is the process by which high speed B/W direct positive images are now generally obtained.

SUMMARY OF THE INVENTION

Accordingly, a first object of the present invention is to provide a process by which the sharpness and edge effect of direct positive images are improved. A second object is to provide a process by which reversal property does not vary due to variation of the bromine ion concentration in the developing solution or pH thereof. A third object is to provide a process by which variation of the reversal property due to variation of the amount of a fogging agent is improved.

The above-described objects of the present invention have been attained by treating a direct positive silver halide sensitive material containing a compound represented by the general formula (I) in at least a sensitive silver halide photographic emulsion layer or another hydrophilic colloid layer applied to a base in the presence of a compound represented by the general formula (II) to obtain direct positive images:

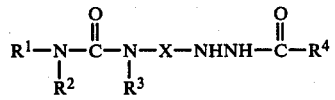

(I)

wherein $R^1$ and $R^2$, which may be identical or different, represent each a hydrogen atom, an aliphatic residue, an aromatic residue or a heterocyclic residue, $R^3$ represents a hydrogen atom or an aliphatic residue, $R^4$ represents a hydrogen atom, an aliphatic residue of an aromatic residue, and X represents a divalent aromatic residue;

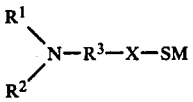

(II)

wherein $R^1$ and $R^2$ represent each a hydrogen atom or an aliphatic residue, and $R^1$ and $R^2$ may form a ring by linking together, $R^3$ represents a divalent aliphatic residue, X represents a single bond or a divalent heterocyclic ring containing nitrogen, oxygen or sulfur atoms, and M represents a hydrogen atom, an alkali metal, an alkaline earth metal, a quaternary ammonium salt, a quaternary phosphonium salt or an amidino group.

DETAILED DESCRIPTION OF THE INVENTION

Figure 1:
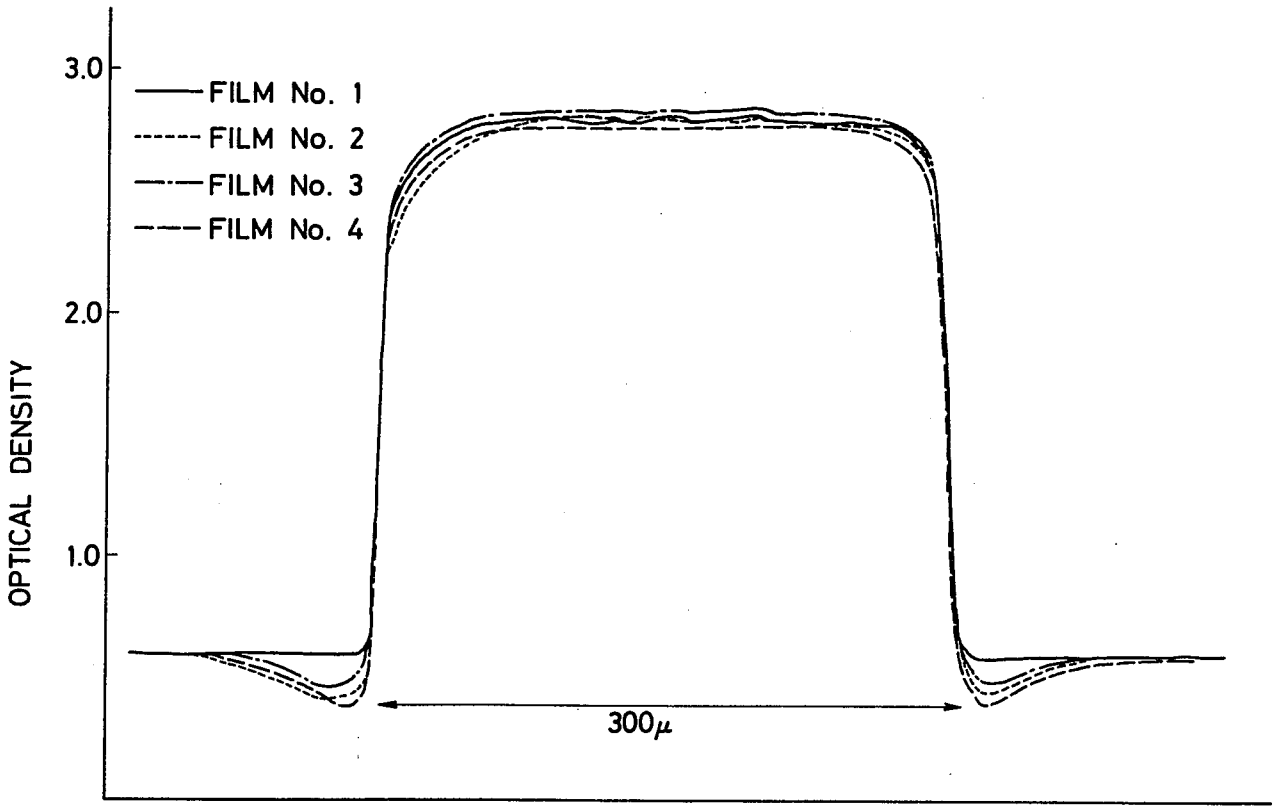
FIG. 1 shows density patterns in the width direction of linear images having a width of 300μ which are measured by a microdensitometer. The ordinate indicates the optical density of linear images and the abscissa indicates the width direction of the linear images.

The present invention can be described in greater detail by more particularly defining the compound represented by the general formula (I). The aliphatic residues of $R^1$, $R^2$ and $R^3$ include straight chain or branched chain alkyl groups, cycloalkyl groups and those having substituents, alkenyl groups and alkynyl groups. Examples of the straight chain or branched chain alkyl groups of $R^1$ and $R^2$ include alkyl groups having 1 to 18 carbon atoms and preferably 1 to 8 carbon atoms, specific examples of which include a methyl group, an ethyl group, an isobutyl group and a t-octyl group, etc. Examples of straight chain or branched chain alkyl groups of $R^4$ include those having 1 to 10 carbon atoms, specific examples of which include a methyl group, an ethyl group and a propyl group, etc.

Examples of the cycloalkyl groups of $R^1$, $R^2$ and $R^4$ include those having 3 to 10 carbon atoms, specific examples of which include a cyclopropyl group, a cyclohexyl group and an adamantyl group, etc. Examples of substituents for the alkyl groups and the cycloalkyl groups include alkoxy groups (for example, a methoxy group, an ethoxy group, a propoxy group and a butoxy group, etc.), alkoxycarbonyl groups, carbamoyl groups, a hydroxy group, alkylthio groups, amido groups, acyloxy groups, a cyano group, sulfonyl groups, halogen atoms (for example, chlorine, bromine, fluorine and iodine, etc.), and aryl groups (for example, a phenyl group, halogen substituted phenyl groups and alkyl substituted phenyl groups), etc., examples of which include a 3-methoxypropyl group, an ethoxycarbonylmethyl group, a 4-chlorocyclohexyl group, a benzyl group, a p-methylbenzyl group and a p-chlorobenzyl group, etc. Further, as the alkenyl group, there is, for example, an allyl group. As the alkynyl group, there is, for example, a propargyl group.

Examples of aromatic residues of $R^1$, $R^2$ and $R^4$ include a phenyl group, a naphthyl group and those having substituents (for example, an alkyl group, an alkoxy group, an acylhydrazino group, a dialkylamino group, an alkoxycarbonyl group, a cyano group, a carboxyl group, a nitro group, an alkylthio group, a hydroxyl group, a sulfonyl group, a carbamoyl group, a halogen atom, an acylamino group, a sulfonamido group and a thiourea group, etc.). Examples of the residues having substituents include a p-methoxyphenyl group, an o-methoxyphenyl group, a tolyl group, a p-formylhydrazino group, a p-chlorophenyl group, an m-fluorophenyl group, an m-benzamido group, an m-acetamido group, an m-benzenesulfonamido group and an m-phenylthiourea group, etc.

The heterocyclic residues of $R^1$ and $R^2$ include 5-member or 6-member monocyclic or fused rings having at least one atom of oxygen, nitrogen, sulfur and selenium wherein the rings may have substituents. Examples of the residues include a pyrroline ring, a pyridine ring, a quinoline ring, an indole ring, an oxazole ring, a benzoxazole ring, a naphthoxazole ring, an imidazole ring, a benzimidazole ring, a thiazoline ring, a thiazole ring, a benzothiazole ring, a naphthothiazole ring, a selenazole ring, a benzoselenazole ring and a naphthoselenazole ring, etc.

These heterocyclic rings may be substituted by alkyl groups having 1 to 4 carbon atoms such as a methyl group or an ethyl group, etc., alkoxy groups having 1 to 4 carbon atoms such as a methoxy group or an ethoxy group, etc., aryl groups having 6 to 18 carbon atoms such as a phenyl group, etc., halogen atoms such as chlorine or bromine, etc., alkoxycarbonyl groups, a cyano group and an amido group, etc.

It is preferred that at least one of $R^1$ and $R^2$ represents a hydrogen atom. Further, it is preferred that $R^4$ represents a hydrogen atom or a methyl group, and particularly, a hydrogen atom.

The aliphatic residue represented by $R^3$ includes straight chain or branched chain alkyl groups, cycloalkyl groups and those having substituents, alkenyl groups and alkynyl groups. As the straight chain or branched chain alkyl groups, there are, for example, alkyl groups having 1 to 18 carbon atoms and, preferably, 1 to 6 carbon atoms, examples of which include a methyl group, an ethyl group and an isopropyl group, etc. As the cycloalkyl groups, there are, for example, those having 3 to 10 carbon atoms, examples of which include a cyclopentyl group and a cyclohexyl group, etc. Examples of substituents include alkoxy groups (for example, a methoxy group and an ethoxy group, etc.), alkoxycarbonyl groups, aryl groups (for example, a phenyl group, a halogen substituted phenyl group, an alkoxyphenyl group and an alkylphenyl group, etc.), amido groups and acyloxy groups, etc. Examples of the groups having substituents include a 3-methoxypropyl group, a benzyl group, a p-chlorobenzyl group, a p-methoxybenzyl group and a p-methylbenzyl group, etc. As the alkenyl groups, there are those having 3 to 12 carbon atoms, preferable examples of which include an allyl group and a 2-butenyl group.

$R^3$ is preferably a hydrogen atom.

X represents a divalent aromatic residue, examples of which include a phenylene group, naphthylene groups (1,2-, 1,4-, 2,3-, 1,5- and 1,8-, etc.) and those having substituents.

As substituents of the divalent aromatic residues, there are, for example, alkyl groups having 1 to 20 carbon atoms (which may be branched), aralkyl groups having 1 to 3 carbon atoms in the alkyl moiety, alkoxy groups (preferably having 1 to 20 carbon atoms), substituted alkoxy groups (preferably having 1 to 20 carbon atoms), mono- or di-substituted amino groups substituted by alkyl groups or substituted alkyl groups (1 to 20 carbon atoms), aliphatic acylamino groups (preferably having 2 to 21 carbon atoms), aromatic acylamino groups, alkylthio groups, hydroxyl groups and halogen atoms (for example, chlorine, etc.), etc.

A more preferred example of X is a phenylene group. Among compounds represented by the general formula (I), particularly preferred compounds are those represented by:

$$R^1-NH\overset{\overset{\displaystyle O}{\|}}{C}NH-X-NHNHCHO \qquad (I')$$

wherein $R^1$ and X represent each the same meaning as in the general formula (I).

Examples of the fogging agent useful in the present invention are described in the following.

I-1—1-Formyl-2-[4-(3-phenylureido)phenyl]hydrazine
I-2—2-{4-[3-(4-Chlorophenyl)ureido]phenyl}-1-formylhydrazine
I-3—2-{4-[3-Chlorophenyl)ureido]phenyl}-1-formylhydrazine
I-4—1-Formyl-2-{4-[3-(4-methoxyphenyl)ureido]-phenyl}hydrazine
I-5—1-Formyl-2-{2-methoxy-4-[3-(4-methylphenyl-)ureido]phenyl}hydrazine
I-6—1-Formyl-2-{4-[3-(2-methoxyphenyl)ureido]-phenyl}hydrazine
I-7—2-{4-[3-(3-Acetamidophenyl)ureido]phenyl}-1-formylhydrazine
I-8—1-Formyl-2-[3-(3-phenylureido)phenyl]hydrazine
I-9—1-Formyl-2-[4-(3-methylureido)phenyl]hydrazine
I-10—2-[4-(3-Ethylureido)phenyl]-1-formylhydrazine
I-11—1-Formyl-2-[4-(3-propylureido)phenyl]hydrazine
I-12—2-[4-(3-n-Butylureido)phenyl]-1-formylhydrazine
I-13—2-[4-(3-t-Butylureido)phenyl]-1-formylhydrazine
I-14—1-Formyl-2-[4-(3-pentylureido)phenyl]hydrazine
I-15—2-[4-(3-Dodecylureido)phenyl]-1-formylhydrazine
I-16—1-Formyl-2-[4-(3-octadecylureido)phenyl]hydrazine
I-17—2-[4-(3-Cyclohexylureido)phenyl]-1-formylhydrazine
I-18—2-[4-(3-Benzylureido)phenyl]-1-formylhydrazine
I-19—2-[4-(3-Allylureido)phenyl]-1-formylhydrazine
I-20—2-[4-(3-Ethoxycarbonylmethylureido)phenyl]-1-formylhydrazine
I-21—1-Formyl-2-{4-[3-(2-pyridyl)ureido]phenyl}hydrazine
I-22—1-Formyl-2-{4-[3-(2-thienyl)ureido]phenyl}hydrazine
I-23—2-[4-{3-[3-(2,4-Di-t-amyiphenoxyacetamido]-phenyl]ureido}phenyl]-1-formylhydrazine
I-24—2-{4-[3-(2-Benzothiazolyl)ureido]phenyl}-1-formylhydrazine
I-25—1-Formyl-2-{4-[3-(4-methylthiazol-2-yl)ureido]-phenyl}hydrazine
I-26—2-{4-[3-(3-Benzamidophenyl)ureido]phenyl}-1-formylhydrazine
I-27—2-{4-[3-(3-Benzenesulfonamidophenyl)ureido]-phenyl}1-formylhydrazine
I-28—1-Formyl-2-{4-[3-(3-nitrophenyl)ureido]phenyl} hydrazine
I-29—1-Formyl-2-[4-{3-[3-(3-phenylthioureido)phenyl-]ureido}phenyl]hydrazine
I-30—1-Acetyl-2-[4-(3-phenylureido)phenyl]hydrazine
I-31—1-Benzoyl-2-[4-(3-phenylureido)phenyl]hydrazine
I-32—1-(4-Chlorobenzoyl)-2-[2-methyl-4-(3-phenylureido)phenyl]hydrazine
I-33—1-Cyclohexylcarbonyl-2-[4-(3-phenylureido)-phenyl]hydrazine
I-34—1-Formyl-2-{4-[3-(4-methylphenyl)ureido]-phenyl}hydrazine Among these examples, particularly preferred compounds are I-1, I-2, I-6, I-23, I-27 and I-34.

In the direct positive sensitive materials of the present invention, the compound represented by the general formula (I) is preferably incorporated in an inner latent image type silver halide emulsion, but it may be incorporated in a hydrophilic colloid layer adjacent to the inner latent image type silver halide emulsion layer. As such a layer, any layer may be utilized if it does not prevent diffusion of the fogging agent into the inner latent image type silver halide, such as a sensitive layer, an intermediate layer, a filter layer, a protective layer or an antihalation layer, etc.

The fogging agent of the present invention is preferably present in the layer in such an amount that a sufficient maximum density (for example, 1.70 or more) is obtained when the inner latent image type emulsion is developed in a surface developing solution. In practice, a suitable amount can vary over a wide range, because it depends upon properties of the silver halide emulsion used, chemical structure of the fogging agent and development conditions. However, the inventors have found that a useful amount is in a range from about 0.1 mg to 5,000 mg per mol of silver in the inner latent image type silver halide emulsion and, preferably, about 0.5 mg to about 2,000 mg per mol of silver. When the fogging agent is incorporated into a hydrophilic colloid layer adjacent to the emulsion layer, it may be used in the same amount as described above based on the silver present in the same area of the inner latent image type emulsion.

The compounds represented by the abovedescribed formula (I) are incorporated in at least one layer of the silver halide photographic sensitive material in an amount, preferably ranging from $10^{-8}$ to $10^{-1}$ mol/mol Ag and, more preferably, ranging from $10^{-6}$ to $10^{-2}$ mol/mol Ag.

The compounds represented by the general formula (I) can be easily synthesized according to the process described in U.S. Pat. No. 4,374,923.

Compounds represented by the general formula

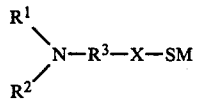

(II)

and inorganic acid salts and organic acid salts thereof will now be described in greater detail. As the aliphatic residues of $R^1$ and $R^2$, there are alkyl groups having 1 to 12 carbon atoms, alkenyl groups and alkinyl groups, which may be substituted by suitable groups. Examples of the alkyl groups include a methyl group, an ethyl group, a propyl group, a butyl group, a hexyl group, a decyl group, an isopropyl group, a sec-butyl group and a cyclohexyl group, etc. Examples of the alkenyl group include an allyl group, a 2-butenyl group, a 2-hexenyl group and a 2-octenyl group, etc. Examples of the alkinyl group include a propargyl group and a 2-pentinyl group, etc. Examples of the substituents include a phenyl group, substituted phenyl groups, alkoxy groups, alkylthio groups, a hydroxyl group, a carboxyl group, a sulfo group, an alkylamino group and amide groups, etc.

When $R^1$ and $R^2$ form a ring, the ring is a 5-member or 6-member carbocyclic or heterocyclic ring composed of carbon atoms or carbon and nitrogen or oxygen atoms, and a saturated ring is particularly preferred. Examples of the ring include

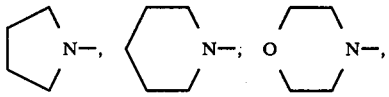

-continued

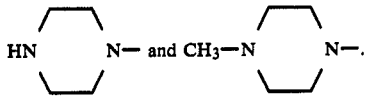

Particularly preferred examples of $R^1$ and $R^2$ include alkyl groups having 1 to 3 carbon atoms, and an ethyl group is more preferred.

As the divalent aliphatic group of $R^3$, $—R^4—$ or $—R^4S—$ is preferred. $R^4$ represents a divalent aliphatic residue and, preferably, a saturated or unsaturated group having 1 to 6 carbon atoms, examples of which include $—CH_2—$, $—CH_2CH_2—$, $—(CH_2)_3—$, $—(CH_2)_4—$, $—(CH_2)_6—$, $CH_2CH{=}CHCH_2—$, $—CH_2C{\equiv}CCH_2—$ and $$—CH_2\underset{\underset{CH_3}{|}}{C}HCH_2—.$$

The preferred number of carbon atoms in $R^4$ is 2 to 4. More preferred examples of $R^4$ include $—CH_2CH_2—$ and $—CH_2CHCH_2—$.

Examples of the heterocyclic ring of X include 5- and 6-membered heterocyclic rings containing a nitrogen, oxygen or sulfur, which may be condensed with a benzene ring. Preferred heterocyclic rings are aromatic rings, examples of which include tetrazole, triazole, thiadiazole, oxadiazole, imidazole, thiazole, oxazole, benzimidazole, benzothiazole, and benzoxazole, etc. Among them, tetrazole and thiadiazole are particularly preferred.

X can be a single bond. When X is a single bond, $R^3$ represents $—R^4—$ only.

Examples of alkali metals of M include $Na^+$, $K^+$, and $Li^+$.

Examples of alkaline earth metals include $Ca^{++}$ and $Mg^{++}$.

Examples of quaternary ammonium salts of M include those having 4 to 30 carbon atoms, examples of which include $(CH_3)_4N^+$, $(C_2H_5)_4N^+$, $(C_4H_9)_4N^+$, $C_6H_5CH_2N^+(CH_3)_3$ and $C_{16}H_{33}N^+(CH_3)_3$, etc. Examples of quaternary phosphonium salts include $(C_4H_9)_4P^+$, $C_{16}H_{33}P^+(CH_3)_3$ and $C_6H_5CH_2P^+(CH_3)_3$.

Examples of the inorganic acid salts of the compounds represented by the general formula (II) include hydrochloride, sulfate, nitrate and phosphate, etc., and examples of the organic acid salts thereof include acetate, propionate, methanesulfonate, benzenesulfonate and p-toluenesulfonate, etc.

In the following, examples of the compounds represented by the general formula (II) are described.

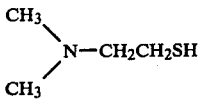

II-1

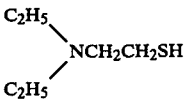

II-2

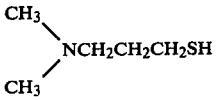

II-3

-continued

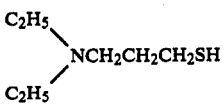

II-4

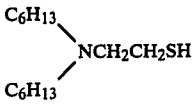

II-5

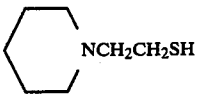

II-6

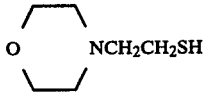

II-7

$(HOCH_2CH_2)_2NCH_2CH_2SH$ II-8

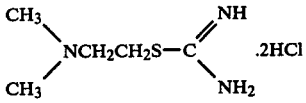

II-9

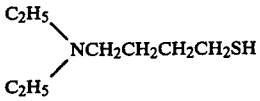

II-10

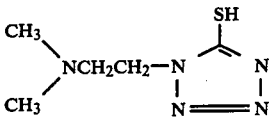

II-11

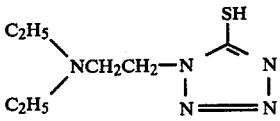

II-12

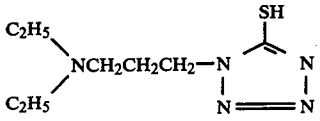

II-13

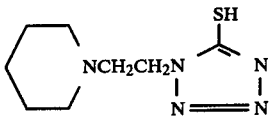

II-14

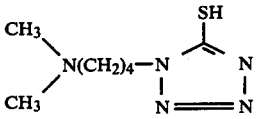

II-15

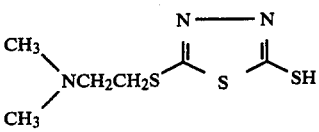

II-16

-continued

II-17

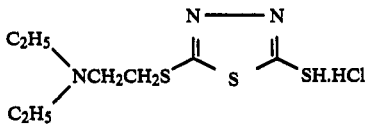

II-18

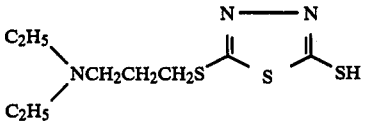

II-19

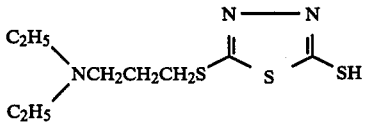

II-20

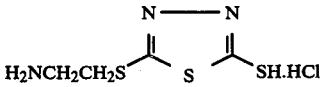

II-21

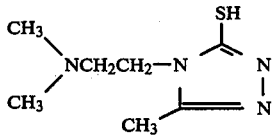

II-22

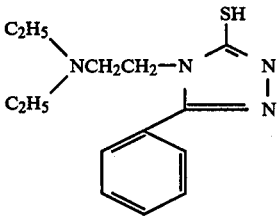

Among these compounds, II-1, II-2 and II-4 are particularly preferred.

The compounds represented by the general formula (II) and inorganic acid salts and organic acid salts thereof can be obtained as follows. When X is a single bond, the mercapto group is introduced by a reaction of $R^1R^2NR^4$-Cl with thiourea. When X is a heterocyclic ring and $R^3$ is $R^4S$, the compounds can be synthesized by a reaction of $R^1R^2NR^4$-Cl with dimercapto substituted heterocyclic ring. When X is a heterocyclic ring and $R^3$ is $R^4$, the compounds can be synthesized by introduction of a heterocyclic ring by a ring closure reaction as described in, for example, U.S. Pat. No. 4,110,338 and Japanese Patent Application (OPI) No. 50169/78.

The compounds represented by the general formula (II) are preferably added in an amount of $10^{-8}$ to $10^{-1}$ mol/mol Ag and, preferably, $10^{-6}$ to $10^{-2}$ mol/mol Ag, when used in the sensitive material. When they are added to a processing solution, they are preferably added in an amount of 0.1 mg to 1 g/l and, more preferably, 1 mg to 100 mg/l.

When adding the compounds represented by the general formula (II) to the sensitive material, they may be added to any of a protective layer, an intermediate layer, a silver halide emulsion layer of undercoating layer. However, they are preferably added to a silver halide emulsion layer or an adjacent layer thereof. Further, when added to the processing solution, it is preferably added to the developing solution.

The inner latent image type emulsion suitable for the present invention contains a core/shell type silver halide particles having a chemically sensitized surface. These particles are composed of a silver halide inner nucleus subjected to metal ion doping and/or chemical sensitization and an outer shell which at least covers a sensitization site of said inner nucleus, and a binder.

In the present invention, examples of silver halides which can be used include silver bromide, silver iodide, silver chloride, silver chlorobromide, silver bromoiodide and silver chlorobromoiodide, etc. Preferable silver halide emulsions contain at least 50% by mol of silver bromide, and the most preferred emulsions are silver bromoiodide emulsions, particularly, those containing less than about 10% by mol of silver iodide.

In the present invention, silver halide particles having various particle sizes can be used, but silver halide particles having an average particle size of about 0.1 to 4 microns, preferably, about 0.1 to 3 microns and, more preferably, about 0.1 to 1.5 microns make it possible to obtain good results.

The silver halide particles may have a regular crystal form such as cube or octahedron, etc., or an irregular crystal form such as sphere or plate, etc., or they may have a combination of these crystal forms. Further, they may be composed of a mixture of particles having various crystal forms.

The core/shell type silver halide particles composing the emulsion of the present invention can be obtained by a process comprising carrying out metal ion doping or chemical sensitization or both of them to prepare silver halide inner nuclei, thereafter coating the surface of them with a silver halide outer shell, and carrying out chemical sensitization of the outer shell. It is not necessary to cover the whole face of particles of inner nuclei with the outer shell, and it is sufficient if at least a sensitization site of the inner nuclei (the part where photolysis silver is formed by exposure) is covered. In order to dope the inner nuclei with metal ions, it is possible to adopt a method of carrying out the step of silver halide formation for inner nuclei or the step of physical ageing in a presence of a metal ion source such as cadmium salts, zinc salts, lead salts, thallium salts, iridium salts or complex salts thereof, rhodium salts or complex salts thereof, or iron salts or complex salts thereof, etc. The metal ions are generally used in an amount of $10^{-6}$ mol or more per mol of silver halide. In place of carrying out doping with metal ions, the silver halide inner nuclei may be subjected to chemical sensitization using at least one of noble metal sensitizers, sulfur sensitizers and reduction sensitizers. When subjected to gold sensitization and sulfur sensitization, the sensitivity increases. Such treatment of the silver halide inner nuclei and the process for covering the surface of silver halide particles composing the inner nuclei with silver halide as an outer shell are known. For example, processes described in U.S. Pat. Nos. 3,206,316, 3,317,322, 3,367,778 (exclusive of a step for fogging the surface of particles) and 3,761,276, etc., can be advantageously adopted.

The ratio of silver halide of the inner nuclei to silver halide of the outer shell is arbitrarily determined. Generally, 2 to 8 mols of the latter per mol of the former are used.

The silver halide of the inner nuclei preferably has the same composition as that of the outer shell, but they may each have a different composition.

The surface of core/shell type silver halide particles prepared as described above is then subjected to chemical sensitization.

The chemical sensitization of the surface of core/shell type silver halide particles is carried out by known methods described in Glafkides, *Chimie et Physique Photographique* (published by Paul Montel Co., 1967), V. L. Zelikman et al., *Making and Coating Photographic Emulsion* (published by The Focal Press, 1964) and *Die Grundlagen der Photographischen Prozesse mit Silberhalogeniden,* edited by H. Frieser (Akademische Verlagsgesellschaft, 1968), etc.

The conditions under which chemical sensitization is carried out may be arbitrarily determined, but good results are generally obtained at a pH of 9 or less, a pAg of 10 or less and a temperature of 40° C. or more. However, if necessary, the conditions may be outside the above-described range. Of course, the chemical sensitization of the surface of core/shell type silver halide particles is carried out to such an extent that the property as inner latent image type of the core/shell type silver halide particles is not damaged.

Here, "property as inner latent image type" means the fact that the maximum density measured by a conventional photographic densitometry, of a silver halide emulsion applied to a transparent base which is exposed to light for a fixed time of 0.01 to 10 seconds and developed with the following developing solution A (inner type developer) at 20° C. for 3 minutes is at least 5 times higher than the maximum density obtained by developing the same exposed silver halide emulsion as described above with the following developing solution B (surface type developer) at 20° C. for 4 minutes.

| | |
|---|---|
| Developing Solution A: | |
| Hydroquinone | 15 g |
| Monomethyl-p-aminophenol sesquisulfate | 15 g |
| Sodium sulfite | 50 g |
| Potassium bromide | 10 g |
| Sodium hydroxide | 25 g |
| Sodium thiosulfate | 20 g |
| Water to make | 1 l |
| Developing Solution B: | |
| p-Oxyphenylglycine | 10 g |
| Sodium carbonate | 100 g |
| Water to make | 1 l |

Inner latent image type emulsions suitable for the present invention include emulsions described in U.S. Pat. No. 2,592,250 as well as emulsions described in Japanese Patent Publication No. 34213/77, British Pat. No. 1,027,146 and U.S. Pat. Nos. 3,206,313, 3,511,662, 3,447,927, 3,737,313, 3,761,276 and 3,271,157, etc. However, the present invention is not limited to them.

In the direct positive photographic sensitive materials of the present invention, various kinds of hydrophilic colloids can be used as a binder.

Examples of colloids used for such a purpose include hydrophilic colloids conventionally used in the photographic field such as gelatin, colloidal albumin, polysaccharides, cellulose derivatives, or synthetic resins such as polyvinyl compounds including polyvinyl alcohol derivatives and polyacrylamide, etc. Hydrophobic colloids, for example, dispersed polyvinyl compounds and, particularly, those which increase dimensional stability of the photographic materials can be incorporated together with the hydrophilic colloid. Preferred examples of this kind of compound include water-insoluble polymers produced by polymerizing vinyl monomers such as alkyl acrylate, alkyl methacrylate, acrylic acid, sulfoalkyl acrylate, or sulfoalkyl methacrylate, etc.

In order to prevent deterioration of sensitivity or occurrence of fogs when producing sensitive materials, during preservation or during processing, various compounds can be added to the above-described photographic emulsions. Examples of such compounds include a number of known compounds such as heterocyclic compounds including 4-hydroxy-6-methyl-1,3,3a,7-tetraazaindene, 3-methylbenzothiazole and 1-phenyl-5-mercaptotetrazole, mercury containing compounds, mercapto compounds and metal salts, etc.

Examples of compounds which can be used are described in K. Mees, *The Theory of the Photographic Process* (3rd Edition, 1966) where original literatures are cited, and U.S. Pat. Nos. 1,758,576, 2,110,178, 2,131,038, 2,173,628, 2,697,040, 2,304,962, 2,324,123, 2,394,198, 2,444,605–2,444,608, 2,566,245, 2,694,716, 2,697,099, 2,708,162, 2,728,663–2,728,665, 2,476,536, 2,824,001, 2,843,491, 2,886,437, 3,052,544, 3,137,577, 3,220,839, 3,226,231, 3,236,652, 3,251,691, 3,252,799, 3,287,135, 3,326,681, 3,420,668 and 3,622,339 and British Pat. Nos. 893,428, 403,789, 1,173,609 and 1,200,188, etc.

In the sensitive materials of the present invention, various kinds of photographic bases can be used. The silver halide emulsions can be applied to one side or both sides of the base.

In the sensitive materials of the present invention, photographic silver halide emulsion layers and other hydrophilic colloid layers can be hardened by suitable hardening agents. Examples of these hardening agents include vinyl sulfonyl compounds described in Japanese Patent Application Nos. 151636/76, 151641/76 and 154494/76, active halogen containing hardening agents, dioxane derivatives and oxypolysaccharides such as oxystarch, etc.

Other additives, particularly, additives useful for photographic emulsions such as lubricants, sensitizers, light absorbing dyes or plasticizers, etc., can be added to the photographic silver halide emulsion layers.

Further, in the present invention, compounds which release iodine ion (for example, potassium iodide, etc.) may be added to the silver halide emulsions, and desired images can be obtained using a developing solution containing iodine ions.

In sensitive materials of the present invention, the hydrophilic colloid layers may contain water-soluble dyes as filter dyes or for the purpose of preventing irradiation or halation or for various other purposes. Examples of such dyes include oxonol dyes, hemioxonol dyes, styryl dyes, merocyanine dyes, cyanine dyes and azo dyes. Among them, oxonol dyes, hemioxonol dyes and merocyanine dyes are useful.

In the sensitive materials of the present invention, hydrophilic colloid layers may be mordanted by cationic polymers when they contain dyes or ultraviolet ray absorbing agents, etc. For example, it is possible to use polymers described in British Patent 685,475, U.S. Pat. Nos. 2,675,316, 2,839,401, 2,882,156, 3,048,487, 3,184,309 and 3,445,231, German Patent Application (OLS) No. 1,914,362, and Japanese Patent Application (OPI) Nos. 47624/75 and 71332/75.

The sensitive materials of the present invention may contain surface active agents for various purposes. Any of nonionic, ionic and ampholytic surface active agents can be used according to the purpose. For example, there are polyoxyalkylene derivatives and amphoteric amino acids (including sulfobetaines), etc. Such surface active agents have been described in U.S. Pat. Nos. 2,600,831, 2,271,622, 2,271,623, 2,275,727, 2,787,604, 2,816,920 and 2,739,891 and Belgian Pat. No. 652,862.

In the sensitive materials of the present invention, the photographic emulsions may be spectrally sensitized to blue light having comparatively long wavelengths, green light, red light or infrared light with sensitizing dyes. As the sensitizing dyes, it is possible to use cyanine dyes, merocyanine dyes, complex cyanine dyes, complex merocyanine dyes, holopolar cyanine dyes, styryl dyes, hemicyanine dyes, oxonol dyes and hemioxonol dyes, etc.

Useful sensitizing dyes used in the present invention are described in, for example, U.S. Pat. Nos. 3,522,052, 3,619,197, 3,713,828, 3,615,643, 3,615,632, 3,617,293, 3,628,964, 3,703,377, 3,666,480, 3,667,960, 3,679,428, 3,672,897, 3,769,026, 3,556,800, 3,614,613, 3,615,638, 3,615,635, 3,705,809, 3,632,349, 3,677,765, 3,770,449, 3,770,440, 3,769,025, 3,745,014, 3,713,828, 3,567,458, 3,625,698, 2,526,632 and 2,503,776, Japanese Patent Application (OPI) No. 76525/73 and Belgian Pat. No. 691,807, etc.

In the present invention, the sensitizing dyes are used in an amount similar to that used for conventional negative silver halide emulsions. It is particularly advantageous to use them in such an amount that they do not substantially deteriorate intrinsic sensitivity of the silver halide emulsions. It is preferable to use the sensitizing dyes in an amount of about $1.0\times10^{-5}$ to about $5\times10^{-4}$ mol per mol of silver halide and, particularly, about $4\times10^{-5}$ to $2\times10^{-4}$ mol per mol of silver halide.

The sensitive materials of the present invention may contain dye image forming couplers. Alternatively, they may be developed with a developing solution containing dye image forming couplers. In order to add the couplers to the silver halide emulsions of the present invention, known suitable methods can be used. For example, methods described in U.S. Pat. Nos. 1,055,155, 1,102,028, 2,186,849, 2,322,027 and 2,801,171 can be used. In the present invention, developing agents such as polyhydroxybenzenes, aminophenols or 3-pyrazolidones, etc., may be added to the emulsions or sensitive materials. In the present invention, the photographic emulsions may be nonhardened ones and they may contain tanning developing agents such as hydroquinone or catechol, etc.

Matting agents and/or smoothing agents may be added to the emulsion layers or the protective layer in the direct positive sensitive materials of the present invention. Examples of the matting agents include organic compounds such as water dispersive vinyl polymers such as polymethyl methacrylate, etc., having a suitable particle size (particularly, 0.3 to 5μ) and inorganic compounds such as silver halide and strontium barium sulfate. The smoothing agents are effective for preventing troubles caused by adhesion, likewise the matting agents, and particularly effective for improving friction properties which have relation to camera adaptability for photographing or projecting movie films. Examples of them include waxes such as liquid paraffin or higher aliphatic acid esters, etc. polyfluorohydrocarbons and derivatives thereof, and silicones such as polyalkylpolysiloxane, polyarylpolysiloxane or alkylene oxide addition derivatives of them.

In the sensitive materials of the present invention, it is possible to provide various auxiliary layers such as a protective layer, an intermediate layer, a filter layer or an antihalation layer, etc.

In order to develop the sensitive materials of the present invention, known various developing agents can be used. Namely, there are polyhydroxybenzenes such as hydroquinone, 2-chlorohydroquinone, 2-methylhydroquinone, catechol or pyrogallol, etc., aminophenols such as p-aminophenol, N-methyl-p-aminophenol or 2,4-diaminophenol, etc., 3-pyrazolidones such as 1-phenyl-3-pyrazolidones, 4,4-dimethyl-1-phenyl-3-pyrazolidone or 5,5-dimethyl-1-phenyl-3-pyrazolidone, etc., and ascorbic acids, etc., which may be used alone or as a combination of them.

The developing solution may contain, as preservatives, sodium sulfite, potassium sulfite, ascorbic acid or reductones (for example, piperidinohexose-reductone), etc.

The sensitive materials of the present invention can be developed with a surface developing solution to obtain direct positive images. When the surface developing solution is used, the development step is induced substantially by latent images or fogging nuclei present on the surface of silver halide particles. Although it is preferred that the developing solution does not contain silver halide solubilizing agents, a small amount of them (for example, sulfites) may be added, if inner latent images do not substantially contribute to development before conclusion of the development by surface development center of silver halide particles.

The developing solution may contain sodium hydroxide, potassium hydroxide, sodium carbonate, potassium carbonate, trisodium phosphate, sodium metaborate, etc., as alkali agents and buffer agents. These agents are added in such amounts that the pH of the developing solution is 10 to 13 and, preferably, 11 to 12.5.

In order to further decrease the minimum density of direct positive images, the developing solution preferably contains compounds which are conventionally used as anti-fogging agents, such as benzimidazoles, for example, 5-nitrobenzimidazole, or benzotriazoles, for example, benzotriazole and 5-methylbenzotriazole, etc.

The sensitive materials of the present invention can be treated with a viscous developing solution. This viscous developing solution is a liquid composition containing components necessary to develop silver halide emulsions and to form diffusion transfer dye images, wherein a chief solvent is water and hydrophilic solvents such as methanol or methyl cellosolve may be present. The processing composition has a pH necessary to cause development of the emulsion layers and contains alkalis in an amount sufficient to neutralize acids formed during various steps of development and dye image formation (for example, hydrohalogenic acids such as hydrobromic acid, etc., and carboxylic acids such as acetic acid, etc.). Examples of useful alkalis include lithium hydroxide, sodium hydroxide, potassium hydroxide, calcium hydroxide, tetramethyl ammonium hydroxide, alkali metal salts, alkaline earth metal salts and amines, such as sodium carbonate, trisodium phosphate and diethylamine. It is preferable to include caustic alkali in an amount which makes the pH 10 or more and, preferably, 12 or more at room temperature. More preferably, the processing composition contains hydrophilic polymers such as polyvinyl alcohol having a high molecular weight, hydroxyethyl cellulose or sodium carboxymethyl cellulose. These polymers used for the processing composition may have a viscosity of 1 poise or more and they preferably have poise of several hundreds, generally in a range of 500 to 600 and more preferably have a poise of about 1,000.

It is advantageous for the processing composition to also include light absorbing substances such as $TiO_2$, carbon black or pH indicator dyes or desensitizers described in U.S. Pat. No. 3,579,333 in order to prevent fogging of silver halide emulsions by outside light during or after treatment in case of, particularly, a monosheet film unit. Further, development restrainers such as benzotriazole can be added to the processing composition.

It is preferred that the above-described processing composition is used within a destructible container as described in U.S. Pat. Nos. 2,543,181, 2,643,886, 2,653,732, 2,723,051, 3,056,491, 3,056,492 and 3,152,515, etc.

In the following, examples of the present invention are illustrated, but the present invention is not limited to them.

EXAMPLE 1

Solutions of silver nitrate and potassium bromide having each the same molar concentration were simultaneously blended at a temperature of 55° C. for 20 minutes according to a controlled double jet method to obtain a silver bromide emulsion. After completing precipitation, cubic crystals having an average side length of 0.1μ were formed. To the silver bromide emulsion, 40 mg of sodium thiosulfate per mol of silver and 40 mg of chloroauric acid (4 hydrate) per mol of silver were added and chemical sensitization was carried out by heating to 75° C. for 60 minutes. Using the resulting silver bromide particles as cores, crystals were grown by adding solutions of silver nitrate and potassium bromide by a simultaneous blending method to obtain octahedral core/shell particles having an average side length of 0.25μ. In order to carry out surface sensitization, 3.4 mg of sodium thiosulfate per mol of silver and 3.4 mg of chloroauric acid (4 hydrate) per mol of silver were added and the mixture was heated to 60° C. for 60 minutes to prepare an inner latent image type direct positive emulsion (Emulsion I).

To the Emulsion I, the fogging agent I-1 represented by the general formula (I) of the present invention was added in an amount of 800 mg per mol of silver, and further, Compounds II-1, II-2 and II-4 of the present invention (general formula (II)) were added as described in Table 1. These emulsions were applied to polyethylene terephthalate bases so as to result in a silver content of 3,000 mg/m$^2$, and a gelatin protective layer was applied to the resulting emulsion layer to produce Samples 1 to 4. On these samples, a line having a width of 300μ was superposed together with a step-wedge, and the samples were exposed to light for 1 second by a 1 kw tungsten lamp at a color temperature of 2,854° K. and then developed at 35° C. for 1 minute with the Developing Solution (A) described in Table 2. Then, stopping, fixation and water wash were carried out according to conventional methods. The developed films had a positive step image and a linear image having a width of about 300μ which was formed on the step image. In order to examine sharpness of the image, a density pattern in the width direction of the linear image having a width of about 300μ on the part where the density of step image was 0.5 was measured by a microdensitometer. Results of measurement are shown in FIG. 1. The results show that the edge effect is remarkable and the sharpness of the linear image is improved in Films No. 2, No. 3 and No. 4 as compared to Film No. 1. Further, the linear image of them is also visually sharp.

TABLE 1

| Sample | Compound | Amount of Compound Represented by General Formula (II) (mg/mol Ag) |
|---|---|---|
| Film No. 1 | Only (I-1) | — |
| Film No. 2 | (I-1) + (II-1) | 150 |
| Film No. 3 | (I-1) + (II-2) | 100 |
| Film No. 4 | (I-1) + (II-4) | 150 |

TABLE 2

| | |
|---|---|
| Developing Solution (A) | |
| Sodium sulfite | 50 g |
| Potassium carbonate | 40 g |
| Sodium bromide | 5 g |
| Pyrazon | 2 g |
| Hydroquinone | 22 g |
| 5-Methylbenzotriazole | 20 mg |
| Water to make | 1 l |
| pH was adjusted to 11.6 with potassium hydroxide. | |
| Stopping Solution | |
| 5 wt % aqueous solution of acetic acid. | |
| Fixing Solution | |
| Ammonium thiosulfate | 200 g |
| Sodium sulfite | 30 g |
| Water to make | 1 l |
| pH was adjusted to 7.0. | |

EXAMPLE 2

To Emulsion I prepared in Example 1, the fogging agent I-1 was added in an amount of 800 mg per mol of silver. The emulsion was applied to a polyethylene terephthalate base so as to result in a silver content of 3,000 mg/m$^2$, and a gelatin protective layer was applied to the resulting layer. A line having a width of 300μ was put on the resulting sample, and the sample was exposed to light for 1 second by a 1 kw tungsten lamp at a color temperature of 2,854° K. and then developed at 35° C. for 1 minute with Developing Solutions (A), (B), (C) and (D) described in Tables 2 and 3. Then, stopping, fixation and water wash were carried out according to conventional methods (similar to Example 1). On the samples, a linear image having a width of about 300μ was obtained. In order to examine sharpness of the linear image, a density pattern was measured by a microdensitometer. From the viewpoint of image sharpness and the sense of sight, films treated with the Developing Solutions (B), (C) and (D) had better sharpness than the film treated with Developing Solution (A).

TABLE 3

| | Developing Solution | | |
|---|---|---|---|
| | (B) | (C) | (D) |
| Sodium sulfite | 50 g | " | " |
| Potassium carbonate | 40 g | " | " |
| Sodium bromide | 5 g | " | " |
| Pyrazon | 2 g | " | " |
| Hydroquinone | 22 g | " | " |
| 5-Methylbenzotriazole | 20 mg | " | " |
| Compound II-1 | 30 mg | — | — |
| Compound II-2 | — | 20 mg | — |
| Compound II-4 | — | — | 30 mg |
| Water to make | 1 l | 1 l | 1 l |

pH was adjusted to 11.6 with potassium hydroxide.

EXAMPLE 3

To Emulsion (I) prepared in Example 1, the following Comparative Fogging Agents A, B and C were added in amounts of 27 mg, 10 mg and 130 mg per mol of silver, respectively. These emulsions were applied to polyethylene terephthalate bases to produce Films No. 5, No. 6 and No. 7.

Comparative Fogging Agent:

A

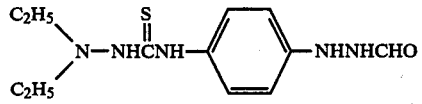

B

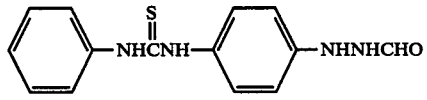

(Fogging agent described in U.S. Pat. No. 4,030,925)

C

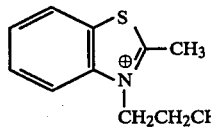

(Fogging agent described in U.S. Pat. No. 3,759,901)

These films were treated together with Films No. 1, No. 2, No. 3 and No. 4 in Example 1 with Developing Solution A and the following Developing Solutions E and F having each a different pH and a different amount of NaBr at 35° C. for 1 minute, and thereafter stopping, fixation and water wash were carried out according to conventional methods.

$D_{max}$ and $D_{min}$ of the developed films were measured. Results are shown in Table 4.

| | Developing Solution | |
|---|---|---|
| | (E) | (F) |
| Sodium sulfite | 50 g | 50 g |
| Potassium carbonate | 40 g | 40 g |
| Sodium bromide | 5 g | 8 g |
| Pyrazon | 2 g | 2 g |
| Hydroquinone | 22 g | 22 g |
| 5-Methylbenzotriazole | 20 mg | 20 mg |
| Water to make | 1 l | 1 l |
| pH was adjusted with potassium hydroxide | 11.4 | 11.6 |

TABLE 4

| | Developing Solution | | | | | |
|---|---|---|---|---|---|---|
| | A | | E | | F | |
| | $D_{max}$ | $D_{min}$ | $D_{max}$ | $D_{min}$ | $D_{max}$ | $D_{min}$ |
| The present invention | | | | | | |
| Film No. 1 | 2.50 | 0.08 | 2.30 | 0.08 | 2.20 | 0.07 |
| Film No. 2 | 2.60 | 0.08 | 2.60 | 0.08 | 2.55 | 0.07 |
| Film No. 3 | 2.55 | 0.08 | 2.55 | 0.08 | 2.50 | 0.07 |
| Film No. 4 | 2.55 | 0.08 | 2.55 | 0.08 | 2.50 | 0.07 |
| Comparative Example | | | | | | |
| Film No. 5 | 2.5 | 0.08 | 1.50 | 0.08 | 1.00 | 0.07 |
| Film No. 6 | 1.50 | 0.13 | 0.80 | 0.09 | 0.50 | 0.08 |
| Film No. 7 | 2.00 | 0.05 | 1.00 | 0.04 | 0.70 | 0.04 |

Table 4 shows that the $D_{max}$ and $D_{min}$ are stable with respect to variations of pH and NaBr when using the fogging agent of the present invention (Film No. 1) as compared with the case of using comparative fogging agents (Films No. 5, No. 6 and No. 7).

Further, it is understood that the $D_{max}$ and $D_{min}$ are stabler in Films No. 2, No. 3 and No. 4 containing the compound of the present invention than in Film No. 1.

While the invention has been described in detail and with reference to specific embodiments thereof, it will be apparent to one skilled in the art that various changes and modifications can be made therein without departing from the spirit and scope thereof.

What is claimed is:

1. A method of treating a photographic material for forming a direct positive image, comprising the steps of:

providing a direct positive silver halide sensitive material which has been imagewise exposed to light and comprising a base having thereon a fogging compound represented by the general formula (I), an inner latent image type sensitive silver halide photographic emulsion layer which is not previously fogged, and a hydrophilic colloid layer; and developing the material in the presence of a compound represented by the general formula (II):

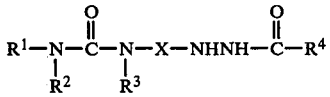

(I)

wherein $R^1$ and $R^2$ independently represent a hydrogen atom, an aliphatic residue, an aromatic residue or a heterocyclic residue, $R^3$ represents a hydrogen atom or an aliphatic residue, $R^4$ represents a hydrogen atom, an aliphatic residue or an aromatic residue, and X represents a divalent aromatic residue;

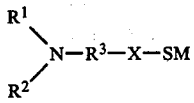

(II)

wherein $R^1$ and $R^2$ represent each a hydrogen atom or an aliphatic residue, and $R^1$ and $R^2$ may form a ring by linking together, $R^3$ represents a divalent aliphatic residue, X represents a single bond or a divalent heterocyclic ring containing one or more nitrogen, oxygen or sulfur atoms, and M represents a hydrogen atom, an alkali metal, an alkaline earth metal, a quaternary ammonium group, a quaternary phosphonium group or an amidino group said compound represented by formula (II) is present in an amount sufficient to improve the sharpness and edge effect of said direct-positive image.

2. A method of treatment is claimed in claim 1, wherein within compounds (I) one of $R^1$ or $R^2$ is hydrogen.

3. A method of treatment as claimed in claim 1, wherein within compound (I) $R^4$ is hydrogen or a methyl group.

4. A method of treatment as claimed in claim 3, wherein within compound (I) $R^4$ is hydrogen.

5. A method of treatment as claimed in claim 1, wherein the compound (I) is incorporated within the sensitive silver halide photographic emulsion layer.

6. A method of treatment as claimed in claim 1, wherein the compound (I) is contained within the hydrophilic colloid layer.

7. A method of treatment as claimed in claim 5, wherein the compound (I) is present in an amount of 0.1 mg to 5,000 mg/mol of silver.

8. A method of treatment as claimed in claim 1, wherein within the compound (II) $R^1$ and $R^2$ form a ring.

9. A method of treatment as claimed in claim 8, wherein the ring is a 5-member or 6-member carbocyclic or heterocyclic ring comprised of carbon atoms or carbon atoms and nitrogen or oxygen atoms.

10. A method of treatment as claimed in claim 9, wherein the ring is saturated.

11. A method of treatment as claimed in claim 1, wherein within compound (II) $R^1$ and $R^2$ represent alkyl groups containing 1 to 3 carbon atoms.

12. A method of treatment as claimed in claim 1, wherein the compound (II) is present in an amount of from $10^{-8}$ to $10^{-1}$ mol/mol of silver.

13. A method of treatment as claimed in claim 1, wherein the compound (II) is present in a processing solution in an amount of 1 mg/l to 100 mg/l.

14. A direct positive silver halide photosensitive material comprising a base having thereon a fogging compound represented by the general formula (I):

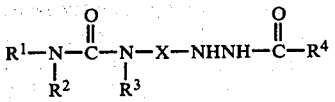

(I)

wherein $R^1$ and $R^2$ independently represent a hydrogen atom, an aliphatic residue, an aromatic residue or a heterocyclic residue, $R^3$ represents a hydrogen atom or an aliphatic residue, $R^4$ represents a hydrogen atom, an aliphatic residue or an aromatic residue, and X represents a divalent aromatic residue; and a compound represented by the general formula (II):

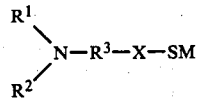

(II)

wherein $R^1$ and $R^2$ represent each a hydrogen atom or an aliphatic residue, and $R^1$ and $R^2$ may form a ring by linking together, $R^3$ represents a divalent aliphatic residue, X represents a single bond or a divalent heterocyclic ring containing one or more nitrogen, oxygen or sulfur atoms, and M represents a hydrogen atom, an alkali metal, an alkaline earth metal, a quaternary ammonium group, a quaternary phosphonium group or am amidino group, said compounds represented by the general formula (I) or (II) being present in an inner latent image type sensitive silver halide photographic emulsion layer which is not previously fogged or a hydrophilic colloid layer, said compound represented by formula (II) is present in an amount sufficient to improve the sharpness and edge effect of a direct-positive image formed by said direct-positive silver halide photosensitive material.

15. A direct positive silver halide photosensitive material as claimed in claim 14, wherein the compound (I) is present in an amount of 0.1 mg to 5,000 mg/mol of silver.

16. A direct positive silver halide photosensitive material as claimed in claim 14, wherein the compound (II) is present in an amount of from $10^{-8}$ to $10^{-1}$ mol/mol of silver.

17. A direct positive silver halide photosensitive material as claimed in claim 14, wherein the compound represented by the general formula (I) is present in the silver halide photographic emulsion layer in an amount of $10^{-8}$ to $10^{-1}$ mol/mol of silver and the compound represented by the general formula (II) is present in an amount of $10^{-8}$ to $10^{-1}$ mol/mol of silver.

* * * * *